US009332366B2

(12) United States Patent
Wu

(10) Patent No.: US 9,332,366 B2
(45) Date of Patent: May 3, 2016

(54) LOUDSPEAKER NOISE INSPECTION METHOD, LOUDSPEAKER NOISE INSPECTION DEVICE AND RECORDING MEDIUM FOR RECORDING A LOUDSPEAKER NOISE INSPECTION PROGRAM

(71) Applicants: LITE-ON OPTO TECHNOLOGY (CHANGZHOU) CO., LTD., Jiangsu Province (CN); LITE-ON TECHNOLOGY CORP., Taipei (TW)

(72) Inventor: Chiang-Kai Wu, Taipei (TW)

(73) Assignees: Lite-On Opto Technology (Changzhou) Co., Ltd., Jiangsu Province (CN); Lite-On Technology Corp., Taipei (TW)

( * ) Notice: Subject to any disclaimer, the term of this patent is extended or adjusted under 35 U.S.C. 154(b) by 135 days.

(21) Appl. No.: 14/274,856

(22) Filed: May 12, 2014

(65) Prior Publication Data

US 2014/0341381 A1 Nov. 20, 2014

(30) Foreign Application Priority Data

May 15, 2013 (CN) ..... 2013 1 0181305

(51) Int. Cl.
*H04R 29/00* (2006.01)
*H04R 3/00* (2006.01)

(52) U.S. Cl.
CPC ..... *H04R 29/001* (2013.01); *H04R 29/008* (2013.01); *H04R 3/007* (2013.01)

(58) Field of Classification Search
None
See application file for complete search history.

(56) References Cited

U.S. PATENT DOCUMENTS

| | | | | |
|---|---|---|---|---|
| 8,396,227 | B2 * | 3/2013 | Lutz | 324/623 |
| 2003/0187636 | A1 * | 10/2003 | Klippel | H04R 29/001 704/220 |
| 2010/0246840 | A1 * | 9/2010 | Lutz | H04R 29/001 381/59 |
| 2011/0211705 | A1 * | 9/2011 | Hutt | 381/59 |
| 2013/0322584 | A1 * | 12/2013 | Kumar | H04L 27/266 375/349 |

FOREIGN PATENT DOCUMENTS

| | | | | |
|---|---|---|---|---|
| DK | WO02/25997 | * | 3/2002 | H04R 29/00 |

* cited by examiner

*Primary Examiner* — Brenda Bernardi
(74) *Attorney, Agent, or Firm* — Rosenberg, Klein & Lee

(57) ABSTRACT

A loudspeaker noise inspection method is to be implemented by an electronic device and includes the steps of: obtaining a frequency sweeping audio signal from an audio output generated by a loudspeaker in response to a frequency sweeping input signal; performing differentiation upon the frequency sweeping audio signal so as to generate a differentiated frequency sweeping audio signal; and dividing the differentiated frequency sweeping audio signal by a constant which is greater than 2π times a maximum frequency of the frequency sweeping audio signal, so as to obtain an attenuated frequency sweeping audio signal for inspection of a noise pulse in the frequency sweeping audio signal.

16 Claims, 7 Drawing Sheets

LOUDSPEAKER NOISE INSPECTION METHOD, LOUDSPEAKER NOISE INSPECTION DEVICE AND RECORDING MEDIUM FOR RECORDING A LOUDSPEAKER NOISE INSPECTION PROGRAM

CROSS-REFERENCE TO RELATED APPLICATION

This application claims priority of Chinese Patent Application No. 201310181305.2, filed on May 15, 2013.

BACKGROUND OF THE INVENTION

1. Field of the Invention

The present invention relates to a loudspeaker noise inspection method, a loudspeaker noise inspection device and a recording medium for recording a loudspeaker noise inspection program.

2. Description of the Related Art

A conventional method for inspecting whether a loudspeaker (i.e., a speaker product or a single speaker) may generate noise is to input a frequency sweeping audio signal input signal to the loudspeaker so that the loudspeaker generates an audio output from which a frequency sweeping audio signal P(t) shown in FIG. 1 may be obtained. The frequency sweeping audio signal P(t) includes frequencies ranging from low to high. Subsequently, an inspector listens to the audio output represented by the frequency sweeping audio signal P(t) so as to determine whether a noise pulse N exists in the frequency sweeping audio signal P(t). Since an amplitude of the noise pulse N is relatively small with respect to that of the frequency sweeping audio signal P(t) (i.e., the sound of the noise pulse N is subtle relative to the audio output), a ratio between the noise pulse N and the frequency sweeping audio signal P(t) is very small. The inspector is thus often required to turn up the volume of the loudspeaker and listen carefully to the audio output so as to recognize the subtle loudness of the noise pulse N in the frequency sweeping audio signal P(t). Therefore, loudspeakers outputting noise pulses may not be sifted out effectively. Moreover, excessive volume is harmful to the inspector's health.

SUMMARY OF THE INVENTION

Therefore, an object of the present invention is to provide a loudspeaker noise inspection method, a loudspeaker noise inspection device and a recording medium for recording a loudspeaker noise inspection program, so as to facilitate sifting out a loudspeaker that outputs a noise pulse, and so as to reduce the harm done to an inspector's hearing.

In a first aspect, the loudspeaker noise inspection method of the present invention is to be implemented by an electronic device, and comprises the steps of:

(A) obtaining, using the electronic device, a frequency sweeping audio signal from an audio output generated by a loudspeaker in response to a frequency sweeping input signal;

(B) performing, using the electronic device, differentiation upon the frequency sweeping audio signal so as to generate a differentiated frequency sweeping audio signal; and (C) dividing, using the electronic device, the differentiated frequency sweeping audio signal by a constant which is greater than $2\pi$ times a maximum frequency of the frequency sweeping audio signal, so as to obtain an attenuated frequency sweeping audio signal for inspection of a noise pulse in the frequency sweeping audio signal.

In a second aspect, the loudspeaker noise inspection method of the present invention is to be implemented by an electronic device and comprising the steps of:

(a) obtaining, using the electronic device, a frequency sweeping audio signal from an audio output generated by the loudspeaker in response to a frequency sweeping audio input signal;

(b) performing, using the electronic device, differentiation upon the frequency sweeping audio signal so as to generate a differentiated frequency sweeping audio signal;

(c) dividing, using the electronic device, the differentiated frequency sweeping audio signal by a constant which is greater than $2\pi$ times a maximum frequency of the frequency sweeping audio signal, so as to obtain an attenuated frequency sweeping audio signal;

(b1) performing, using the electronic device, differentiation upon the attenuated frequency sweeping audio signal so as to generate a second-order differentiated frequency sweeping audio signal;

(c1) dividing, using the electronic device, the second-order differentiated frequency sweeping audio signal by the constant so as to obtain a second attenuated frequency sweeping audio signal;

(d) outputting, using the electronic device, at least one of the attenuated frequency sweeping audio signal and the second attenuated frequency sweeping audio signal in one of an audio form and a video form; and (e) inspecting whether a noise pulse is in the attenuated frequency sweeping audio signal or in the second attenuated frequency sweeping audio signal presented in one of the audio form and the video form.

In a third aspect, the loudspeaker noise inspection device of the present invention comprises a sound pick-unit and a digital signal processor. The sound pick-up unit is configured to obtain a frequency sweeping audio signal from an audio output generated by a loudspeaker in response to a frequency sweeping input signal. The digital signal processor is coupled electrically to the sound pick-up unit, is configured to perform differentiation upon the frequency sweeping audio signal so as to generate a differentiated frequency sweeping audio signal, and is configured to divide the differentiated frequency sweeping audio signal by a constant which is greater than $2\pi$ times a maximum frequency of the frequency sweeping audio signal, so as to obtain an attenuated frequency sweeping audio signal for inspection of a noise pulse in the frequency sweeping audio signal.

In a fourth aspect, the loudspeaker noise inspection device of the present invention comprises a sound pick-up unit, a digital signal processor, and an output unit. The sound pick-up unit is configured to obtain a frequency sweeping audio signal from an audio output generated by a loudspeaker in response to a frequency sweeping audio input signal. The digital signal processor is coupled electrically to the sound pick-up unit, and is configured to perform differentiation upon the frequency sweeping audio signal so as to generate a differentiated frequency sweeping audio signal, to divide the differentiated frequency sweeping audio signal by a constant which is greater than $2\pi$ times a maximum frequency of the frequency sweeping audio signal, so as to obtain an attenuated frequency sweeping audio signal, to perform differentiation upon the attenuated frequency sweeping audio signal so as to generate a second-order differentiated frequency sweeping audio signal, and to divide the second-order differentiated frequency sweeping audio signal by the constant so as to obtain a second attenuated frequency sweeping audio signal. The output unit is configured to output at least one of the attenuated frequency sweeping audio signal and the second attenuated frequency sweeping audio signal in one of an audio form and a video form. The attenuated frequency sweeping audio signal or the second attenuated frequency sweeping audio signal presented in one of the audio form and the video form is utilized for inspecting whether a noise pulse is in the attenuated frequency sweeping audio signal or the second attenuated frequency sweeping audio signal.

In a fifth aspect, the non-transitory recording medium of the present invention is adapted to be accessed by an electronic device. The non-transitory recording medium records a loudspeaker noise inspection program. The electronic device includes a sound pick-up unit that obtains a frequency sweeping audio signal from an audio output generated by a loudspeaker in response to a frequency sweeping input signal. The loudspeaker noise inspection program including instructions which, when executed by the electronic device, cause the electronic device to perform the following steps of:

performing differentiation upon the frequency sweeping audio signal so as to generate a differentiated frequency sweeping audio signal; and dividing the differentiated frequency sweeping audio signal by a constant which is greater than $2\pi$ times a maximum frequency of the frequency sweeping audio signal, so as to obtain an attenuated frequency sweeping audio signal for inspection of a noise pulse in the frequency sweeping audio signal.

BRIEF DESCRIPTION OF THE DRAWINGS

Other features and advantages of the present invention will become apparent in the following detailed description of the two preferred embodiments with reference to the accompanying drawings, of which.

DETAILED DESCRIPTION OF THE PREFERRED EMBODIMENTS

Figure 1:
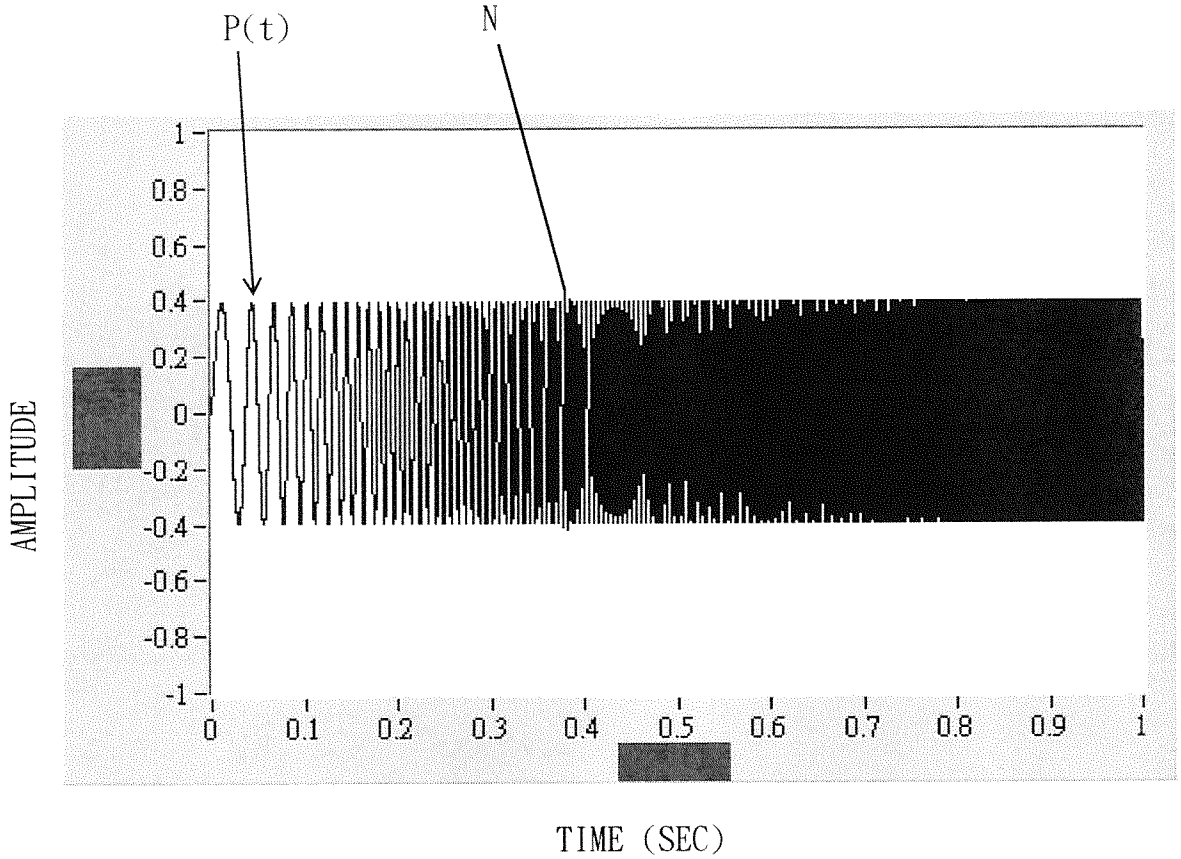
FIG. 1 PRIOR ART
FIG. 1 is an oscillogram illustrating a frequency sweeping audio signal that includes a noise pulse.

Before the present invention is described in greater detail with reference to the preferred embodiments, it should be noted that the same reference numerals are used to denote the same elements throughout the following description.

Figure 2:
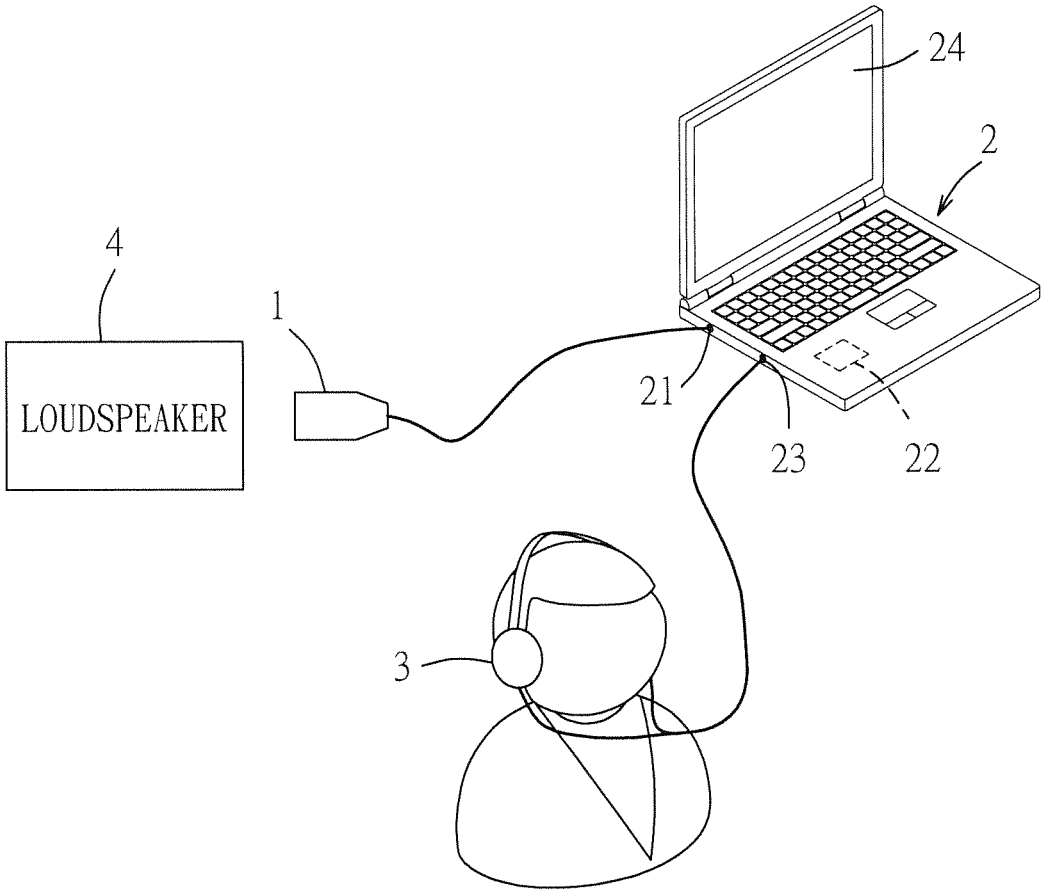
FIG. 2 is a schematic diagram illustrating equipments required to perform a loudspeaker noise inspection method of the present invention.

Referring to FIG. 2, a loudspeaker noise inspection method according to the present invention is to be implemented by an electronic device 2. An embodiment of the electronic device 2 includes a sound pick-up unit 21, a processor 22 and an output unit 23. The sound pick-up unit 21 may be one of a microphone (not shown) built in the electronic device 2, and a microphone socket for connection with an external microphone 1. The output unit 23 is one of a built-in speaker (not shown) or an earphone socket for connect ion with an external earphone 3 or an external speaker. Moreover, the output unit 23 may be a display 24 of the electronic device 2.

Figure 3:
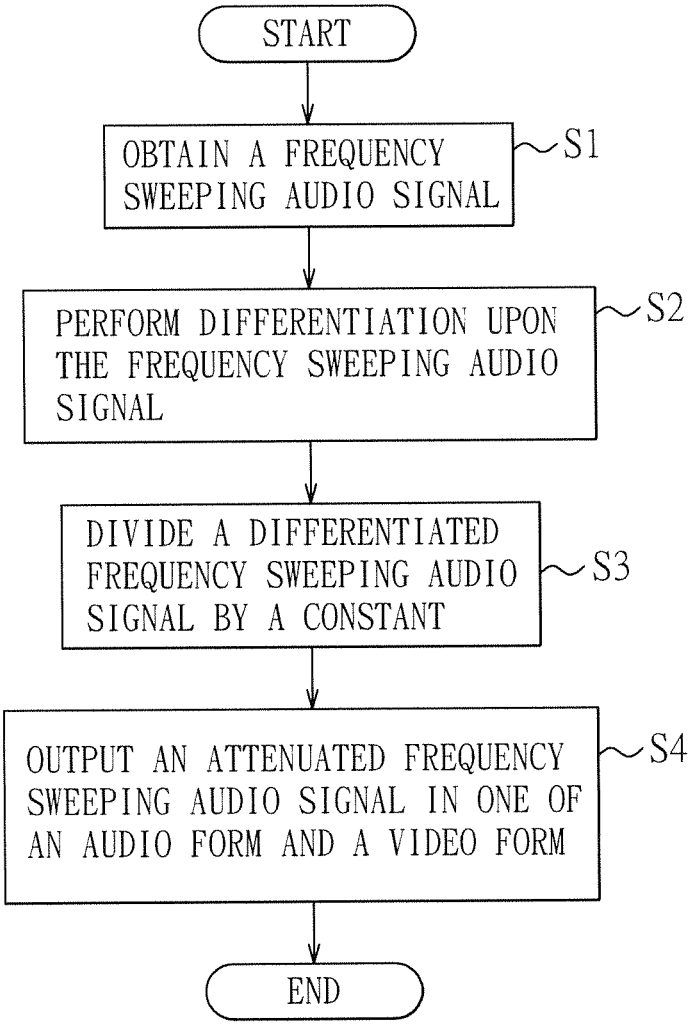
FIG. 3 is a flow chart illustrating a first embodiment of the loudspeaker noise inspection method according to the present invention.

Referring to FIG. 3 in combination with FIG. 2, a first preferred embodiment of the method for processing a frequency sweeping audio signal according to the present invention is illustrated.

In step S1, the sound pick-up unit 21 is operable to obtain a frequency sweeping audio signal P(t), as best shown in FIG. 1, from an audio output generated by a to-be-inspected loudspeaker 4 in response to a frequency sweeping input signal. In this embodiment, the frequency sweeping audio signal P(t) is a sinusoidal signal that has frequencies ranging from low to high. The frequency sweeping input signal may be generated by one of a frequency sweeping audio signal generator (not shown) and the electronic device 2 which is provided with capability to generate the frequency sweeping input signal. If the loudspeaker 4 is flawed during manufacture and assembly, the frequency sweeping audio signal P(t) obtained from the audio output of the loudspeaker 4 may include a noise pulse N which exhibits a weak sound and is hard to recognize. In this embodiment, the frequency range of the frequency sweeping audio signal P(t) usually corresponds to a frequency range of the audio output of the loudspeaker 4, that is, about 20 Hz-430 Hz, but the frequency range is not limited to the disclosure in this embodiment.

The electronic device 2 is one of a notebook computer shown in FIG. 2, a personal computer, a tablet computer, a handheld electronic device (such as a mobile phone or a smart phone), and so forth. The processor 22 is a central processing unit of the electronic device 2 which is able to access a loudspeaker noise inspection program stored in a non-transitory recording medium of the electronic device 2, and which is able to execute the loudspeaker noise inspection program so as to perform step S2. Moreover, when the frequency sweeping audio signal P(t) is an analog signal, the frequency sweeping audio signal is first converted into a digital signal by a sound card (or component with similar function) of the electronic device 2, and then the digital signal is provided to the processor 22.

Alternatively, the electronic device 2 may be a loudspeaker noise inspection device for processing the frequency sweeping audio signal P(t) so as to facilitate inspection of noise of the loudspeaker 4. In this case, the processor 22 may be a digital signal processor, and the aforementioned loudspeaker noise inspection program may be provided to the digital signal processor in a manner of firmware. The digital signal processor is configured to convert the frequency sweeping audio signal P(t) into a digital signal and is configured to execute the loudspeaker noise inspection program so as to perform step S2.

After the processor 22 receives the frequency sweeping audio signal P(t) from the sound pick-up unit 21, step S2 in FIG. 3 is performed by the processor 22. In step S2, the processor 22 is configured to perform differentiation upon the frequency sweeping audio signal P(t) so as to generate a differentiated frequency sweeping audio signal.

In step S3, the processor 22 is configured to divide the differentiated frequency sweeping audio signal by a constant C which is greater than $2\pi$ times a maximum frequency of the frequency sweeping audio signal P(t), so as to obtain an attenuated frequency sweeping audio signal $P_1(t)$. Preferably, the constant C is greater than 2701. In this embodiment, in order to improve an effect of attenuation of the attenuated frequency sweeping audio signal $P_1(t)$, the constant C may be set to 30000.

Figure 4:
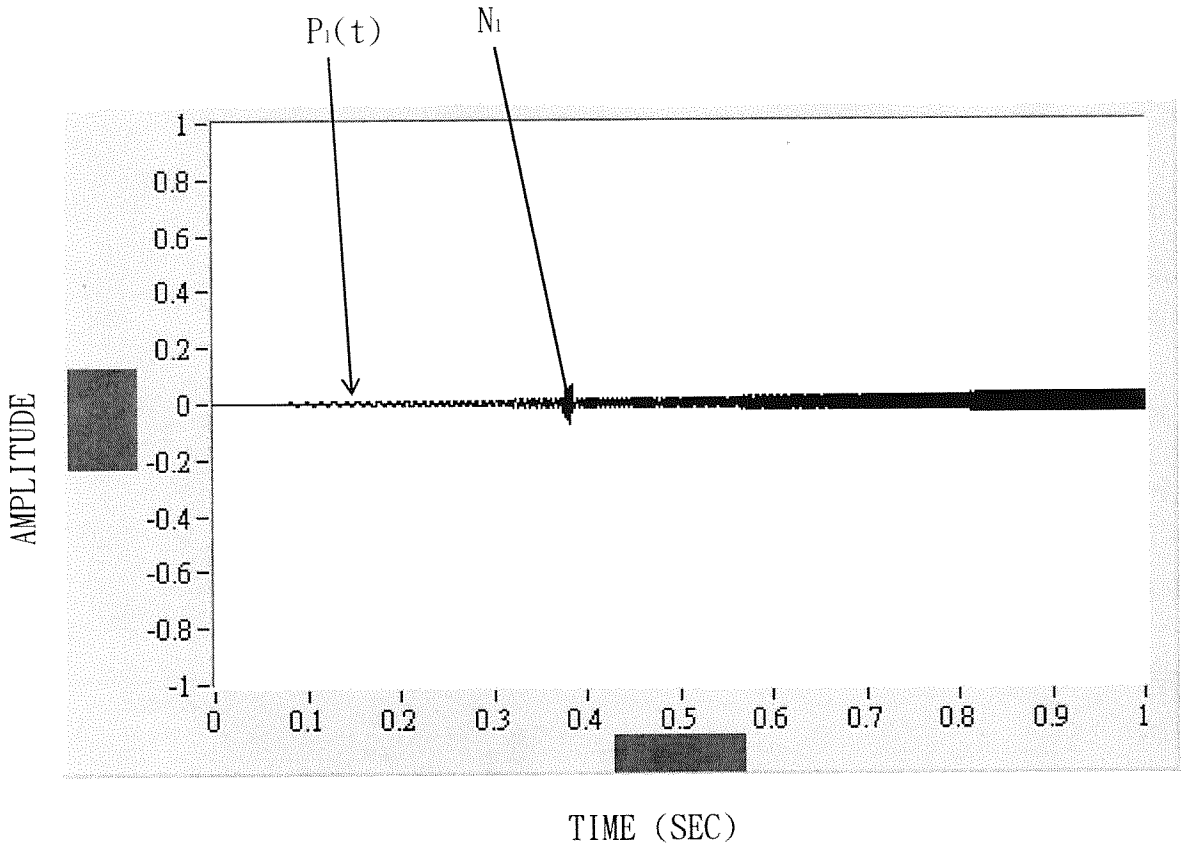
FIG. 4 is a waveform illustrating an attenuated frequency sweeping audio signal obtained from the frequency sweeping audio signal of FIG. 1.

Subsequently, the attenuated frequency sweeping audio signal $P_1(t)$ is provided to the output unit 23. In step S4, the output unit 23 is configured to output the attenuated frequency sweeping audio signal $P_1(t)$ in one of an audio form and a video form. In this embodiment, the output unit 23 outputs the attenuated frequency sweeping audio signal $P_1(t)$ via the earphone 3 in the audio form for listening by an inspector, such that the inspector may determine whether there is a noise pulse in the attenuated frequency sweeping audio signal $P_1(t)$. FIG. 4 illustrates a waveform of the attenuated frequency sweeping audio signal $P_1(t)$. It is noted from FIG. 4 that an amplitude of the attenuated frequency sweeping audio signal $P_1(t)$ is greatly attenuated relative to that of the frequency sweeping audio signal P(t). The noise pulse N in the frequency sweeping audio signal P(t) is made conspicuous after being subjected to the differentiation and being divided by the constant C, such that an amplitude of a noise pulse $N_1$ is relatively increased in the attenuated frequency sweeping audio signal $P_1(t)$. Therefore, a ratio between the amplitude of the noise pulse $N_1$ and that of the attenuated frequency sweeping audio signal $P_1(t)$ is increased. In this way, the inspector may no longer suffer from the high volume of the frequency sweeping audio signal P(t), and may recognize the noise pulse $N_1$ in the attenuated frequency sweeping audio signal $P_1(t)$ with relative ease. Furthermore, since the ratio between the amplitude of the noise pulse $N_1$ and that of the attenuated frequency sweeping audio signal $P_1(t)$ is increased, the attenuated frequency sweeping audio signal $P_1(t)$ may also be outputted to the display 24 of the electronic device 2 for display, so that the inspector may inspect the noise pulse $N_1$ in the attenuated frequency sweeping audio signal $P_1(t)$ by vision.

Figure 5:
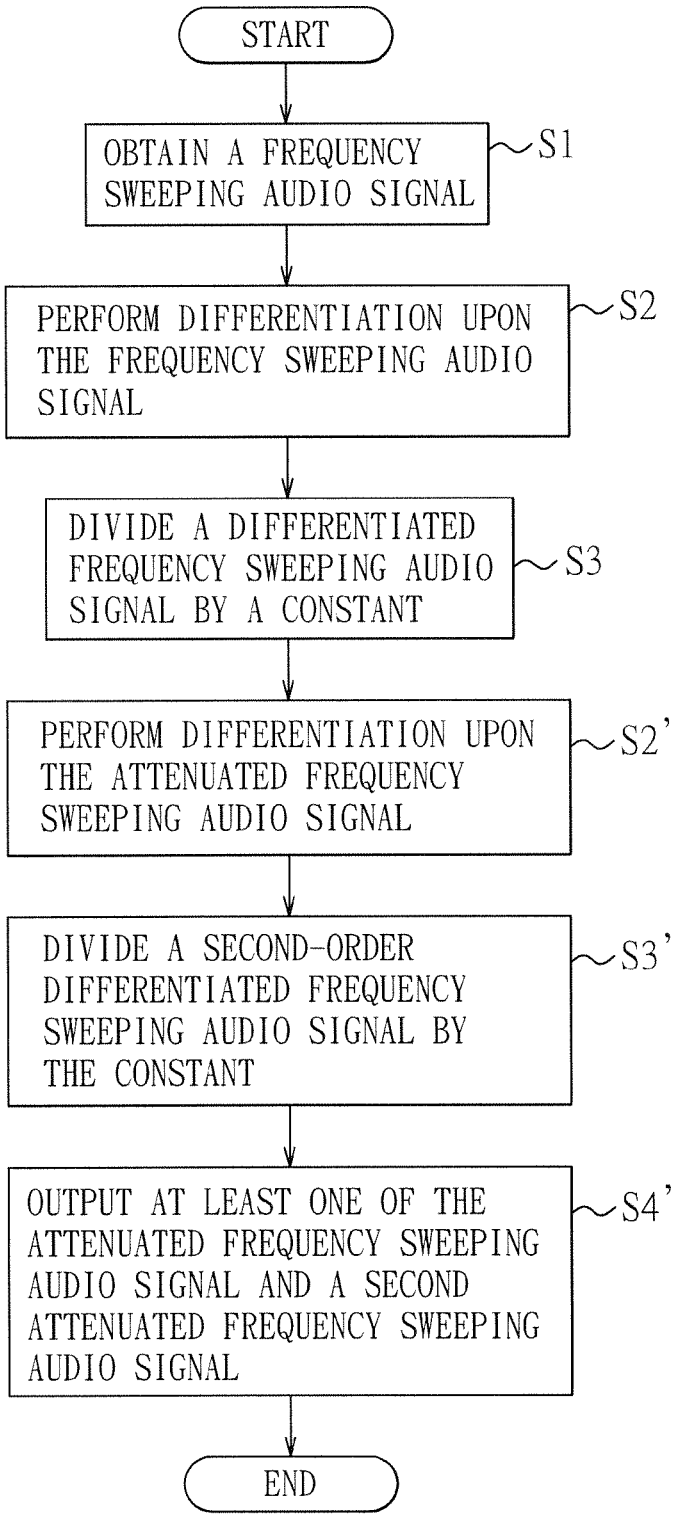
FIG. 5 is a flow chart illustrating a second preferred embodiment of the loudspeaker noise inspection method according to the present invention.

Referring to FIG. 5, a second preferred embodiment of the method for processing a frequency sweeping audio signal according to the present invention is illustrated. The second preferred embodiment is similar to the first preferred embodiment, and differs in that the second preferred embodiment further comprises, after step S3, steps S2' and S3'.

In step S2', the processor 22 is configured to perform differentiation upon the attenuated frequency sweeping audio signal $P_1(t)$ (i.e., a differentiation process), so as to generate a second-order differentiated frequency sweeping audio signal.

Figure 6:
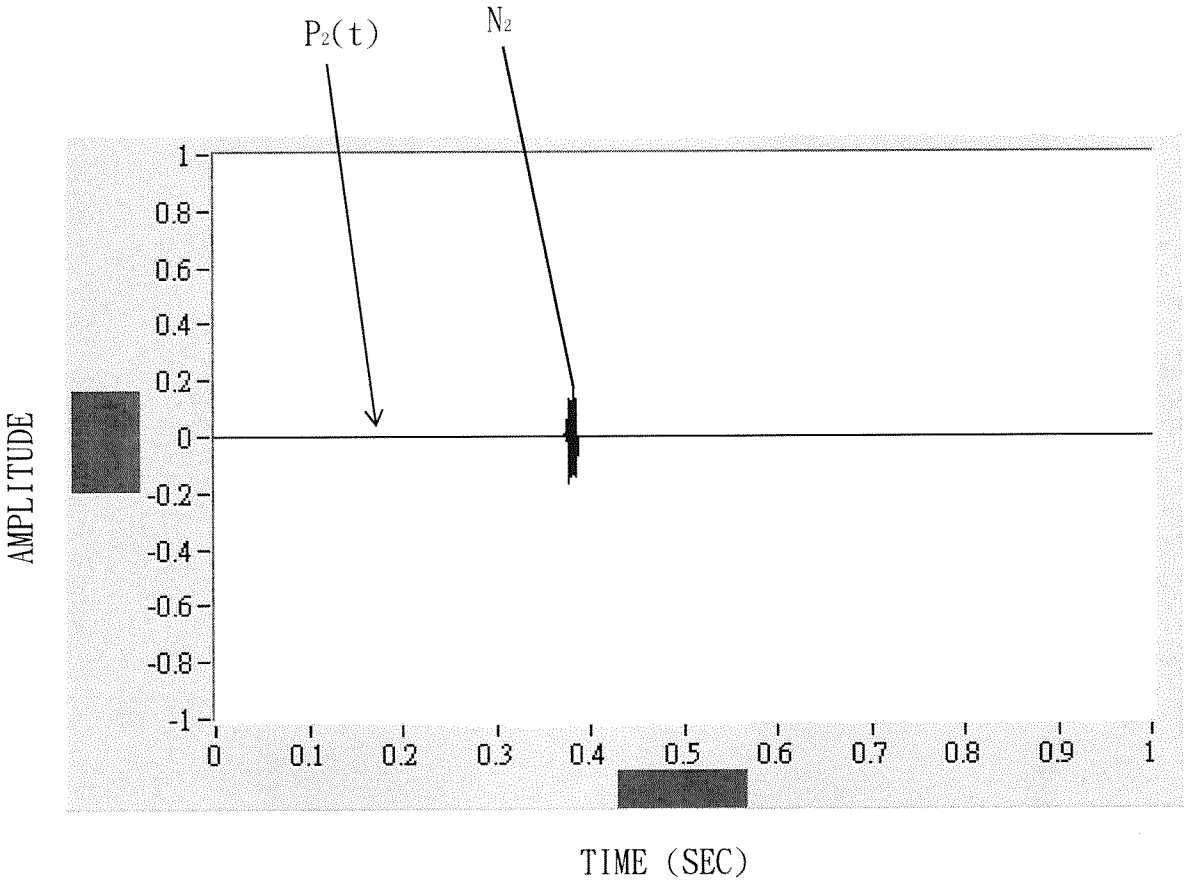
FIG. 6 is a waveform illustrating a second attenuated frequency sweeping audio signal obtained from the attenuated frequency sweeping audio signal of FIG. 4.

In step S3', the processor 22 is configured to divide the second-order differentiated frequency sweeping audio signal by the constant C (i.e., a division process), so as to obtain a second attenuated frequency sweeping audio signal $P_2(t)$ as best shown in FIG. 6. It is noted from FIG. 6 that an amplitude of the second attenuated frequency sweeping audio signal $P_2(t)$ is about zero after the differentiation process in step S2' and the division process in step S3'. The noise pulse $N_1$ after the differentiation process in step S2' and the division process in step S3' becomes a noise pulse $N_2$, and an amplitude of the noise pulse $N_2$ is increased once again with respect to the amplitude of the second attenuated frequency sweeping audio signal $P_2(t)$.

Figure 7:
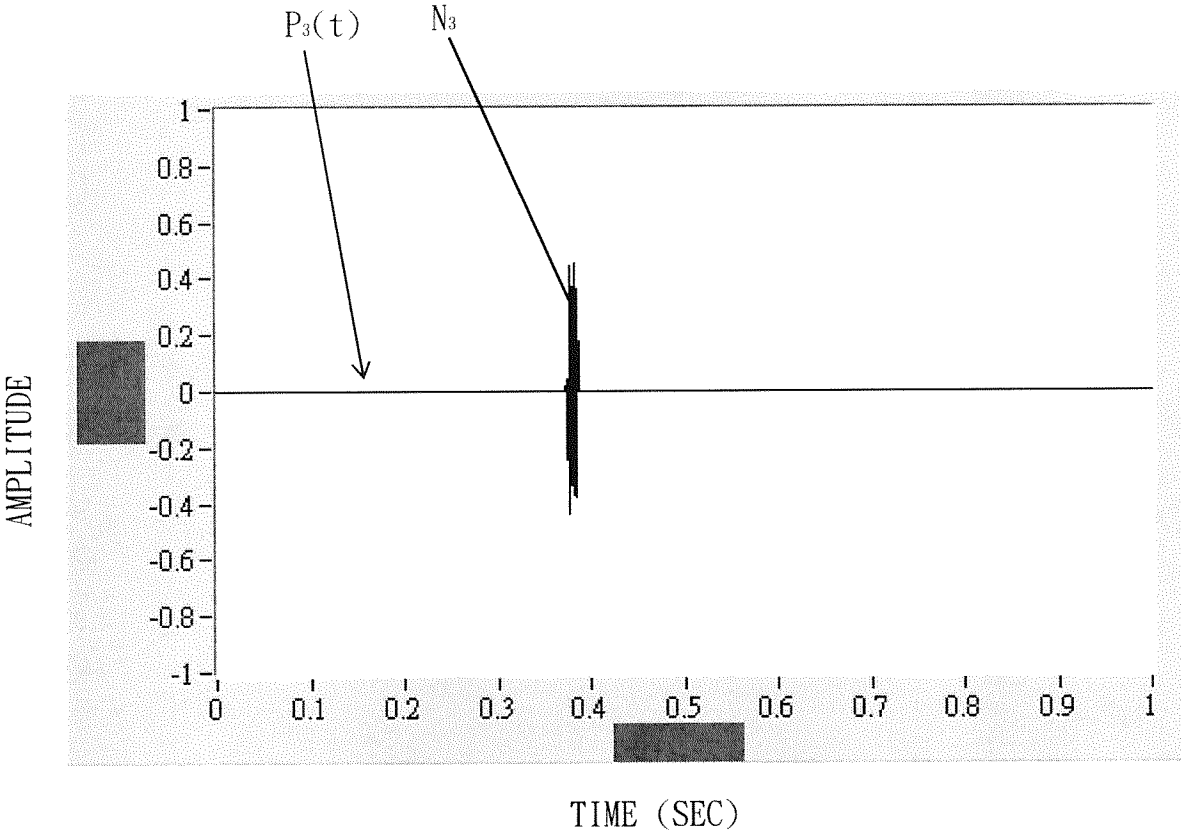
FIG. 7 is a waveform illustrating a third attenuated frequency sweeping audio signal obtained from the second attenuated frequency sweeping audio signal of FIG. 6.

It is noted that the second preferred embodiment is not limited to performing the differentiation process and the division process twice, and may perform the differentiation process and the division process more than two times (e.g., a predetermined number of times) based on different design and needs. For example, in a variation of the second preferred embodiment, when the predetermined number of times is three, after step S3', steps S2" and S3" may be performed. In step S2", the processor 22 is configured to perform differentiation upon the second attenuated frequency sweeping audio signal $P_2(t)$, so as to generate a third-order differentiated frequency sweeping audio signal. In step S3", the processor 22 is configured to divide the third-order differentiated frequency sweeping audio signal by the constant C, so as to obtain a third attenuated frequency sweeping audio signal $P_3(t)$ as best shown in FIG. 7.

Subsequently, in step S4', the output unit 23 is configured to output at least one of the attenuated frequency sweeping audio signal $P_1(t)$ and the second attenuated frequency sweeping audio signal $P_2(t)$ in one of an audio form and a video form. It may be noted from FIG. 7 that an amplitude of the third attenuated frequency sweeping audio signal $P_3(t)$ is proximate to that of the second attenuated frequency sweeping audio signal $P_2(t)$ (i.e., both are about zero). A noise pulse $N_3$ is generated after the differentiation process in step S2" and the division process in step S3", and an amplitude of the noise pulse $N_3$ is further increased to an amount far greater than the amplitude of the noise pulse $N_2$. Therefore, it may be appreciated that, as long as the constant C is set properly, and after three times of the differentiation process and the division process, the frequency sweeping audio signal P(t) may be attenuated to a substantially minimum degree, and the noise pulse N may be increased to a degree that facilitates recognition with ease. In practice, a preferred predetermined number of times for performing the differentiation process and the division process is dependent on the frequency range of the frequency sweeping audio signal P(t). In the variation of the second preferred embodiment, three times is given as an example for the predetermined number of times, but the actual number is not limited to the disclosures of the preferred embodiments herein.

In summary, the present invention, by means of performing differentiation upon the frequency sweeping audio signal P(t) and dividing the differentiated frequency sweeping audio signal by the constant C, is able to attenuate the frequency sweeping audio signal P(t), and to increase the amplitude of the noise pulse N therein. Subsequently, the attenuated frequency sweeping audio signal $P_1(t)$ is outputted by the output unit 23 in one of an audio form and a video form, such that the inspector, by virtue of listening to or viewing the output represented by the attenuated frequency sweeping audio signal $P_1(t)$, is able to inspect the noise pulse in the frequency sweeping audio signal P(t) more easily. In this way, sifting out a loudspeaker that outputs a noise pulse may be promoted, and the harm done to the inspector's hearing may be reduced.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A loudspeaker noise inspection method, the method to be implemented by an electronic device and comprising the steps of:

(A) obtaining, using the electronic device, a frequency sweeping audio signal from an audio output generated by a loudspeaker in response to a frequency sweeping audio input signal;

(B) performing, using the electronic device, differentiation upon the frequency sweeping audio signal so as to generate a differentiated frequency sweeping audio signal;

(C) dividing, using the electronic device, the differentiated frequency sweeping audio signal by a constant which is greater than $2\pi$ times a maximum frequency of the frequency sweeping audio signal, so as to obtain an attenuated frequency sweeping audio signal for inspection of a noise pulse in the frequency sweeping audio signal;

(D) outputting, using the electronic device, the attenuated frequency sweeping audio signal in one of an audio form and a video form; and (E) inspecting whether a noise pulse is in the attenuated frequency sweeping audio signal presented in one of the audio form and the video form, if the noise pulse is inconspicuous in the attenuated frequency sweeping audio signal, the method further comprising, after step (E):

(B1) performing, using the electronic device, differentiation upon the attenuated frequency sweeping audio signal so as to generate a second-order differentiated frequency sweeping audio signal;

(C1) dividing, using the electronic device, the second-order differentiated frequency sweeping audio signal by the constant so as to obtain a second attenuated frequency sweeping audio signal;

(D1) outputting, using the electronic device, the second attenuated frequency sweeping audio signal in one of the audio form and the video form; and (E1) inspecting whether a noise pulse is in the second attenuated frequency sweeping audio signal presented in one of the audio form and the video form.

2. The method as claimed in claim 1, wherein steps (B1) and (C1) are performed by a central processing unit of the electronic device.

3. The method as claimed in claim 1, wherein the electronic device is a loudspeaker noise inspection device, and steps (B1) and (C1) are performed by a digital signal processor of the loudspeaker noise inspection device.

4. The method as claimed in claim 1, wherein the frequency sweeping audio signal is a sinusoidal signal.

5. The method as claimed in claim 1, wherein steps (B) and (C) are performed by a central processing unit of the electronic device.

6. The method as claimed in claim 1, wherein the electronic device is a loudspeaker noise inspection device, and steps (B) and (C) are performed by a digital signal processor of the loudspeaker noise inspection device.

7. A loudspeaker noise inspection method, the method to be implemented by an electronic device and comprising the steps of:

(a) obtaining, using the electronic device, a frequency sweeping audio signal from an audio output generated by the loudspeaker in response to a frequency sweeping audio input signal;

(b) performing, using the electronic device, differentiation upon the frequency sweeping audio signal so as to generate a differentiated frequency sweeping audio signal;

(c) dividing, using the electronic device, the differentiated frequency sweeping audio signal by a constant which is greater than $2\pi$ times a maximum frequency of the frequency sweeping audio signal, so as to obtain an attenuated frequency sweeping audio signal;

(b1) performing, using the electronic device, differentiation upon the attenuated frequency sweeping audio signal so as to generate a second-order differentiated frequency sweeping audio signal;

(c1) dividing, using the electronic device, the second-order differentiated frequency sweeping audio signal by the constant so as to obtain a second attenuated frequency sweeping audio signal;

(d) outputting, using the electronic device, at least one of the attenuated frequency sweeping audio signal and the second attenuated frequency sweeping audio signal in one of an audio form and a video form; and (e) inspecting whether a noise pulse is in the attenuated frequency sweeping audio signal or in the second attenuated frequency sweeping audio signal presented in one of the audio form and the video form.

8. The method as claimed in claim 7, wherein steps (b), (c), (b1) and (c1) are performed by a central processing unit of the electronic device.

9. The method as claimed in claim 7, wherein the electronic device is a loudspeaker noise inspection device, and steps (b), (c), (b1) and (c1) are performed by a digital signal processor of the loudspeaker noise inspection device.

10. The method as claimed in claim 7, wherein the frequency sweeping audio signal is a sinusoidal signal.

11. A loudspeaker noise inspection device comprising:

a sound pick-up unit configured to obtain a frequency sweeping audio signal from an audio output generated by a loudspeaker in response to a frequency sweeping audio input signal;

a digital signal processor coupled electrically to said sound pick-up unit, and configured to perform differentiation upon the frequency sweeping audio signal so as to generate a differentiated frequency sweeping audio signal, and divide the differentiated frequency sweeping audio signal by a constant which is greater than $2\pi$ times a maximum frequency of the frequency sweeping audio signal, so as to obtain an attenuated frequency sweeping audio signal for inspection of a noise pulse in the frequency sweeping audio signal; and an output unit configured to output the attenuated frequency sweeping audio signal in one of an audio form and a video form;

wherein the attenuated frequency sweeping audio signal presented in one of the audio form and the video form is utilized for inspecting whether a noise pulse is in the attenuated frequency sweeping audio signal, and wherein, if the noise pulse is inconspicuous in the attenuated frequency sweeping audio signal, said digital signal processor is further configured to:

perform differentiation upon the attenuated frequency sweeping audio signal so as to generate a second-order differentiated frequency sweeping audio signal; and divide the second-order differentiated frequency sweeping audio signal by the constant so as to obtain a second attenuated frequency sweeping audio signal;

wherein said output unit is further configured to output the second attenuated frequency sweeping audio signal in one of the audio form and the video form; and wherein the second attenuated frequency sweeping audio signal presented in one of the audio form and the video form is utilized for inspecting whether a noise pulse is in the second attenuated frequency sweeping audio signal.

12. The loudspeaker noise inspection device as claimed in claim 11, wherein the frequency sweeping audio signal is a sinusoidal signal.

13. A loudspeaker noise inspection device comprising:

a sound pick-up unit configured to obtain a frequency sweeping audio signal from an audio output generated by a loudspeaker in response to a frequency sweeping audio input signal;

a digital signal processor coupled electrically to said sound pick-up unit, and configured to perform differentiation upon the frequency sweeping audio signal so as to generate a differentiated frequency sweeping audio signal, divide the differentiated frequency sweeping audio signal by a constant which is greater than 2π times a maximum frequency of the frequency sweeping audio signal, so as to obtain an attenuated frequency sweeping audio signal, perform differentiation upon the attenuated frequency sweeping audio signal so as to generate a second-order differentiated frequency sweeping audio signal, and divide the second-order differentiated frequency sweeping audio signal by the constant so as to obtain a second attenuated frequency sweeping audio signal; and an output unit configured to output at least one of the attenuated frequency sweeping audio signal and the second attenuated frequency sweeping audio signal in one of an audio form and a video form;

wherein the attenuated frequency sweeping audio signal or the second attenuated frequency sweeping audio signal presented in one of the audio form and the video form is utilized for inspecting whether a noise pulse is in the attenuated frequency sweeping audio signal or the second attenuated frequency sweeping audio signal.

14. The loudspeaker noise inspection device as claimed in claim 13, wherein the frequency sweeping audio signal is a sinusoidal signal.

15. A non-transitory recording medium accessible to an electronic device, said non-transitory recording medium recording a loudspeaker noise inspection program, the electronic device including a sound pick-up unit that obtains a frequency sweeping audio signal from an audio output generated by a loudspeaker in response to a frequency sweeping audio input signal, the loudspeaker noise inspection program including instructions which, when executed by the electronic device, cause the electronic device to perform the following steps of:

performing differentiation upon the frequency sweeping audio signal so as to generate a differentiated frequency sweeping audio signal; and dividing the differentiated frequency sweeping audio signal by a constant which is greater than 2π times a maximum frequency of the frequency sweeping audio signal, so as to obtain an attenuated frequency sweeping audio signal for inspection of a noise pulse in the frequency sweeping audio signal;

wherein the instructions further cause the electronic device to perform the following steps of:

performing differentiation upon the attenuated frequency sweeping audio signal so as to generate a second-order differentiated frequency sweeping audio signal; and dividing the second-order differentiated frequency sweeping audio signal by the constant so as to obtain a second attenuated frequency sweeping audio signal.

16. The non-transitory recording medium as claimed in claim 15, the electronic device further including a central processing unit and an output unit, wherein said loudspeaker noise inspection program is to be executed by the central processing unit, and the attenuated frequency sweeping audio signal is outputted by said output unit in one of an audio form and a video form.

* * * * *